US007064639B2

(12) United States Patent
Harvey et al.

(10) Patent No.: US 7,064,639 B2
(45) Date of Patent: Jun. 20, 2006

(54) ELECTROMAGNETIC LATCHING SWITCH

(75) Inventors: Arthur James Harvey, Mantua, OH (US); Michael Eric Liedtke, Kent, OH (US); Ted Wetzel, Mayfield, OH (US)

(73) Assignee: Delta Systems, Inc., Streetsboro, OH (US)

( * ) Notice: Subject to any disclaimer, the term of this patent is extended or adjusted under 35 U.S.C. 154(b) by 0 days.

(21) Appl. No.: 10/903,201

(22) Filed: Jul. 30, 2004

(65) Prior Publication Data

US 2006/0022780 A1 Feb. 2, 2006

(51) Int. Cl.
*H01H 9/20* (2006.01)

(52) U.S. Cl. ..... 335/167; 335/165

(58) Field of Classification Search ..... 335/164–179, 335/185–189, 132

See application file for complete search history.

(56) References Cited

U.S. PATENT DOCUMENTS 2,458,014 A * 1/1949 Matson ..... 335/157
2,591,336 A * 4/1952 Bordelon ..... 335/255

* cited by examiner

*Primary Examiner*—Lincoln Donovan
(74) *Attorney, Agent, or Firm*—Watts Hoffmann Co., LPA

(57) ABSTRACT

A magnetic latching switch. The switch includes a pair of switch terminals, a switch actuator, an electromagnet and a biasing member. The switch actuator is manually moveable from a first position where the switch terminals are in a first state to a second position where the switch terminals are in a second state. The electromagnet selectively applies a magnetic field. Applying the magnetic field with the electromagnet when the switch actuator is in the second position maintains the switch actuator in the second position. The biasing member is coupled to the switch actuator such that the biasing member automatically returns the switch actuator from the second position to the first position when the magnetic field is removed.

32 Claims, 6 Drawing Sheets

ELECTROMAGNETIC LATCHING SWITCH

FIELD OF THE INVENTION

The present invention concerns switches and, more particularly, the present invention concerns a magnetic latching switch.

BACKGROUND ART

Electrical switches have many applications. For example, switches have been used in interlock circuits for lawn and garden tractors and similar vehicles, automobile car doors, refrigerator doors, and home appliances. One type of switch is a momentary switch that includes an actuator that is automatically returned to a normal position. The actuator may be returned to the normal position by a biasing member, such as a spring or a dome contact. In the normal position, two terminals of the switch are in a first state (either open or closed). The actuator can be moved to an actuated position by imparting a force on the actuator. For example, the actuator of a pushbutton switch with a normally extended actuator can be depressed by a user's finger or it can be positioned such that closing a door or sitting on a seat moves the actuator from the normal, extended position to an actuated, depressed position. When the actuator is in the second position, the terminals of the switch are in a second state (closed if the terminals were open in the fist state or open if the terminals were closed in the first state). When the force is removed from the actuator, the actuator automatically returns to the normal position.

Another type of switch is a sustained action switch. A two position sustained action switch includes an actuator that is moveable between two positions. The first position corresponds to a first state of the switch terminals and the second position corresponds to a second state of the switch terminals. The actuator can be moved from the first position to the second position by imparting a force on the actuator. The actuator remains in the second position until a second force is applied to the switch actuator to return the actuator to the first position.

SUMMARY

The present application concerns a magnetic latching switch. The magnetic latching switch includes a pair of switch terminals, a switch actuator, an electromagnet and a biasing member. The switch actuator is manually moveable from a first position where the switch terminals are in a first state to a second position where the switch terminals are in a second state. The electromagnet selectively applies a magnetic field. Applying the magnetic field with the electromagnet when the switch actuator is in the second position maintains the switch actuator in the second position. The biasing member is coupled to the switch actuator such that the biasing member automatically returns the switch actuator from the second position to the first position when the magnetic field is removed.

In one embodiment, the magnetic latching switch selectively operates in a momentary switch mode or a sustained action switch mode. In this embodiment, the magnetic latching switch operates as a momentary switch when the electromagnet of the switch is not energized and operates as a sustained action switch when the electromagnet is energized.

In one embodiment, the switch actuator is only manually moveable by the user from the first position to the second position. The force applied to the actuator by the electromagnetic alone is not strong enough to overcome the force of the biasing member and move the actuator from the first position to the second position in this embodiment. The switch actuator is manually moved by the user from the second position to the first position or automatically moved by the biasing member from the second position to the first position by removing the magnetic field.

In one embodiment, application and removal of the magnetic field by the electromagnet is independent of the position of the switch actuator. For example, the electromagnet may be selectively energized by selectively closing an external circuit that couples the electromagnet to a source of electrical power.

One version of the magnetic latching switch includes an electromagnet, first and second switch terminals, a switch actuator, a contact coupled to the switch actuator, a biasing member coupled to the switch actuator, and a metallic member coupled to the switch actuator. The switch actuator is selectively moveable by a user from a first position to a second position. The contact electrically bridges the first and second switch terminals when the switch actuator is in one of the first and second positions and the switch terminals are electrically isolated when the switch actuator is in the other of the first and second positions. The biasing member biases the switch actuator to the first position. A magnetic field applied by the electromagnet to the metallic member when the switch actuator is in the second position maintains the switch actuator in the second position. The biasing member maintains the switch actuator in the first position when the switch actuator is in the first position and the electromagnet is energized.

In one embodiment, the magnetic latching switch includes a pair of electromagnet terminals in addition to the switch terminals. The electromagnet terminals couple the electromagnet to an independent source of power.

In one embodiment, the metallic member contacts a core of the electromagnet when the actuator is in the second position. The metallic member and the contact may be connected to a shaft that maintains a gap between the metallic member and the electromagnet when the actuator is in the first position. The shaft brings the metallic member into contact with the electromagnet when the actuator is moved from the first position to the second position. In one embodiment, the path of travel of the metallic member as the actuator moves from the first position to the second position coincides with an axis defined by the core of the electromagnet.

In one embodiment, the core of the electromagnet includes a flat end surface and the metallic member comprises a substantially flat plate. In this embodiment, the metallic member is in flush contact with the flat surface of the metallic member when the actuator is in the second position and the electromagnet is energized.

In a method of selectively changing the state of a pair of switch terminals, a switch actuator is manually moved from a first position where the switch terminals are in a first state to a second position where the switch terminals are in a second state. A magnetic field is applied to maintain the switch actuator in the second position. The magnetic field is removed to automatically return the switch actuator from the second position to the first position These and other objects and advantages of the system constructed in accordance with an exemplary embodiment of the invention is more completely described in conjunction with the accompanying drawings.

DETAILED DESCRIPTION

Figure 1:
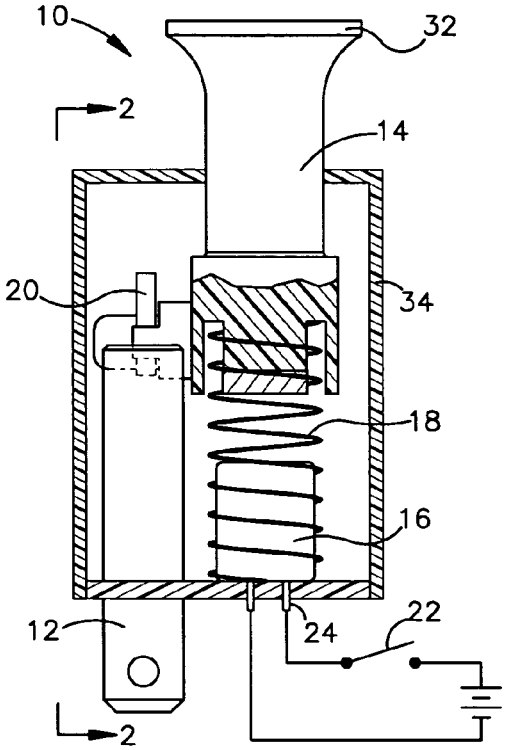
FIG. 1 is a view of an electromagnetic latching switch with an actuator biased to a normal position.
Figure 2:
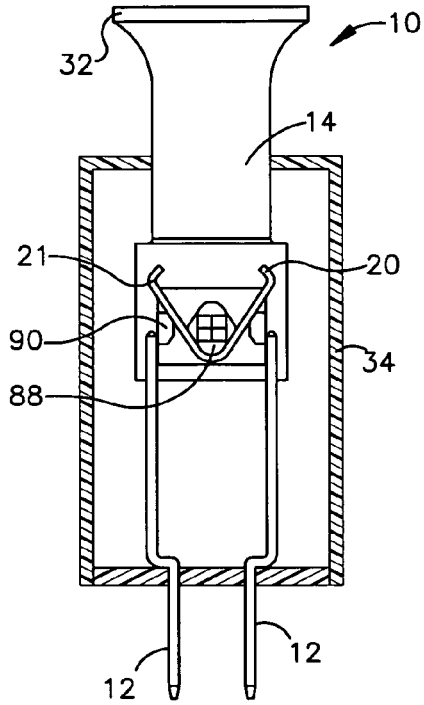
FIG. 2 is a view taken along the plane indicated by lines 2—2 in FIG. 1.
Figure 3:
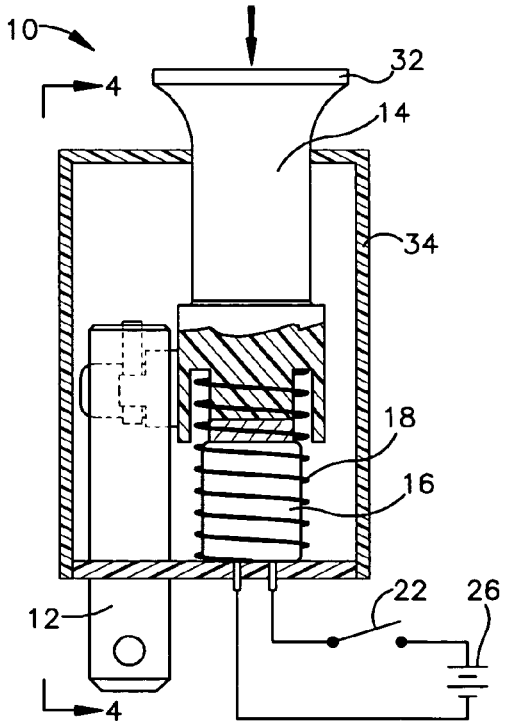
FIG. 3 is a view similar to the view of FIG. 1 with an actuator in an actuated position.
Figure 4:
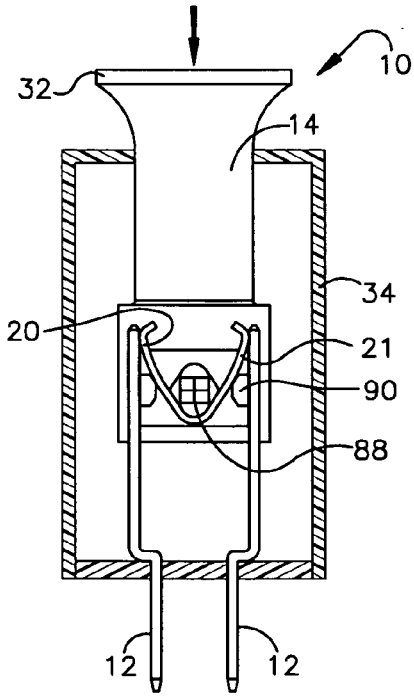
FIG. 4 is a view taken along the plane indicated by lines 4—4 in FIG. 3.

The present disclosure is directed to a magnetic latching switch 10. The magnetic latching switch 10 includes a pair of switch terminals 12, a switch actuator 14, an electromagnet 16, a biasing member 18, and a switch contact 20. The switch actuator 14 is manually moveable from a first position (FIGS. 1 and 2) where the switch terminals 12 are in a first state to a second position (FIGS. 3 and 4) where the switch terminals are in a second state. In the embodiments illustrated by FIGS. 1–8, the terminals 12 are electrically isolated (FIG. 2) in the first state and are bridged (FIG. 4) by the contact 20 in the second state. It should be readily apparent that the magnetic latching switch could be configured such that the terminals 12 are bridged by the contact 20 in the first state and are isolated in the second state. The electromagnet 16 selectively applies a magnetic field. Applying the magnetic field with the electromagnet when the switch actuator is in the second position maintains the switch actuator in the second position. The biasing member 18, illustrated as a spring in the Figures, is coupled to the switch actuator such that the biasing member automatically returns the switch actuator 14 from the second position to the first position when the magnetic field is removed.

The magnetic latching switches 10 illustrated by FIGS. 1–6 and 9–13 selectively operate in a momentary switch mode or a sustained action switch mode. The magnetic latching switches operate as a momentary switch when the electromagnet of the switch is not energized and operates as a sustained action switch when the electromagnet is energized. Energization and de-energization of the electromagnet is independent of the position of the switch actuator. In the embodiments illustrated by FIGS. 1–8, the electromagnet is selectively energized by closing an external switch 22 that couples terminals 24 of the electromagnet 16 to a source 26 of electrical energy, such as a battery.

FIGS. 1–4 illustrate operation of an electromagnetic switch 10 when the switch 22 is open and the electromagnet is thus not energized. The switch actuator 14 is selectively moveable by a user from a first position to a second position. In the embodiment illustrated by FIGS. 1–4, the contact 20 electrically bridges the first and second switch terminals 12 when the switch actuator is in the second position. The switch terminals are electrically isolated when the switch actuator is in the first position. The biasing member 18 is coupled to the switch actuator 14, such that the switch actuator is biased to the first position. The biasing member 18 automatically returns the switch actuator 14 from the second position to the first position when the user is not applying force to the switch actuator and the switch 22 is open.

Figure 5:
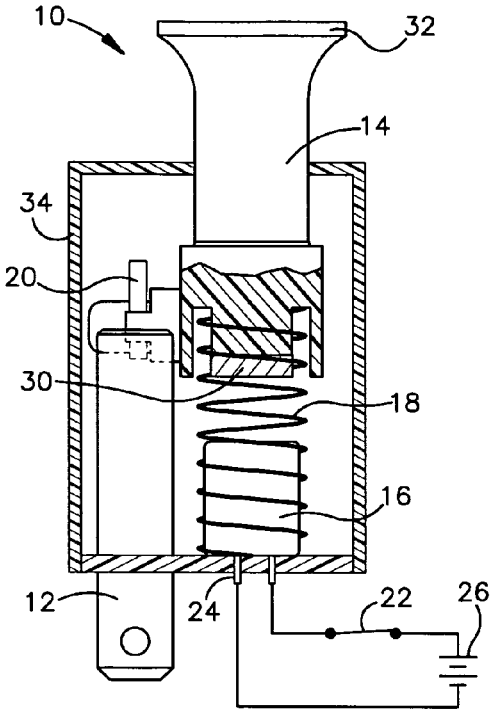
FIG. 5 is a view of an electromagnetic latching switch with an actuator biased to a normal position and an electromagnetic coupled to a source of electrical energy.
Figure 6:
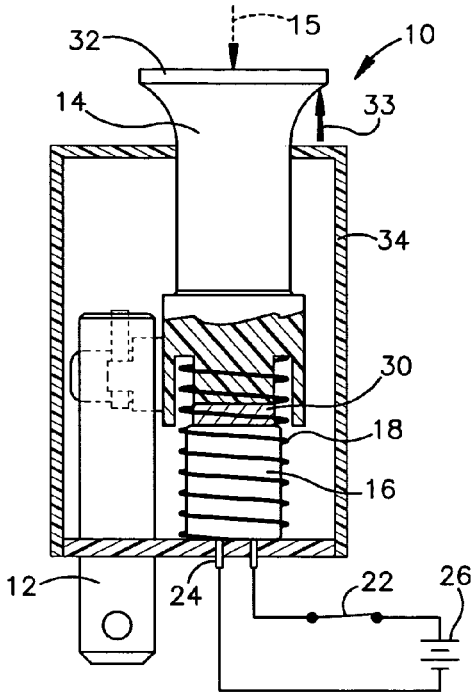
FIG. 6 is a view of an electromagnetic latching switch with an actuator maintained in an actuated position by an electromagnet coupled to a source of electrical energy.

FIGS. 5 and 6 illustrate operation of the electromagnetic switch when the switch 22 is closed to energize the electromagnet. In the embodiment illustrated by FIGS. 5 and 6, a metallic member 30 is coupled to the switch actuator 14. The switch actuator may be manually depressed and released as indicated by arrow 15 in FIG. 6. A magnetic field applied by the electromagnet 16 to the metallic member 30 when the switch actuator 14 is in the second position maintains the switch actuator 14 in the second position. The biasing member maintains the switch actuator 14 in the first position when the magnetic field is applied until the actuator is manually moved to the second position by a user. That is, the switch actuator is only manually moveable by the user from the first position to the second position. The electromagnet cannot move the switch actuator from the first position to the second position.

In the embodiment illustrated by FIGS. 1–6, the switch actuator 14 is both manually moveable by the user from the second position to the first position and automatically movable from the second position to the first position by de-energizing the electromagnet. In FIGS. 1–6, the actuator 14 includes a knob 32 that allows the user to pull the actuator as indicated by arrow 33 in FIG. 6 and overcome the force applied to the actuator by the electromagnet to move the actuator from the second position to the first position. Once in the first position, the distance between the metallic member 30 and the electromagnet 16 and/or the force applied by the biasing member 18 prevents the electromagnet from moving the actuator back to the second position. When the switch 22 is opened to de-energize the electromagnet, the biasing member moves the switch actuator from the second position to the first position, unless the user holds the actuator in the second position.

Figure 7:
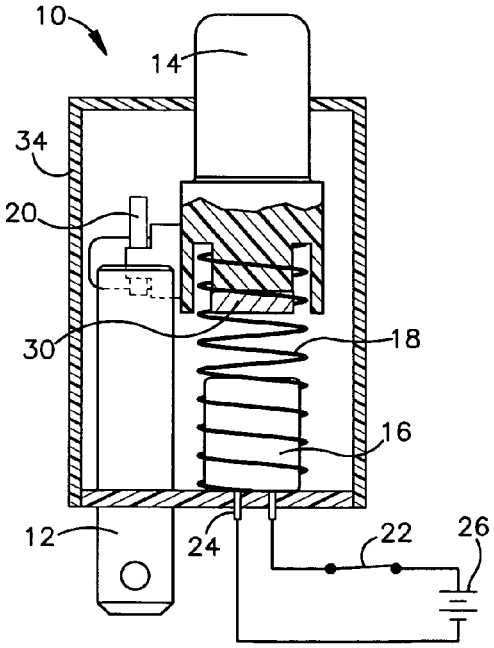
FIG. 7 is a view of an electromagnetic latching switch with an actuator biased to a normal position and an electromagnetic coupled to a source of electrical energy.
Figure 8:
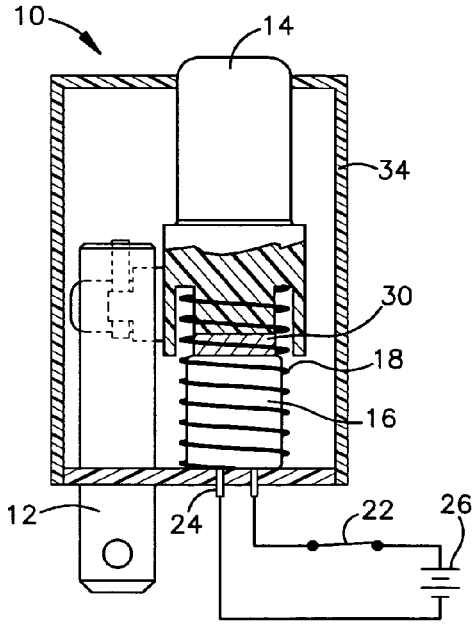
FIG. 8 is a view of an electromagnetic latching switch with an actuator maintained in an actuated position by an electromagnet coupled to a source of electrical energy.

FIGS. 7 and 8 illustrate an embodiment where the switch actuator 14 is only moveable from the second position to the first position by de-energizing the electromagnet. In FIGS. 7 and 8, the actuator 14 is configured to allow the user to move the actuator from the first position to the second position, but prevent the user from moving the actuator from the second position to the first position. In FIGS. 7 and 8 the actuator 14 is substantially flush with or recessed within a switch enclosure 34 to prevent the actuator from being accessed (i.e. by pulling) by the user to move the actuator from the second position to the first position. To return the actuator 14 to the first position, the switch 22 is opened to de-energize the electromagnet. The biasing member 18 moves the switch actuator 14 from the second position to the first position, unless the user holds the actuator in the second position.

FIGS. 9–13 illustrate one example of a magnetic latching switch 10. The magnetic latching switch 10 illustrated by FIGS. 9–13 includes a switch enclosure 34, switch terminals 12, a switch actuator 14, a contact 20, a metallic member 30, a biasing member 18, and an electromagnet 16. The switch enclosure 34 illustrated in FIGS. 9–13 includes a housing 36 and a cover 38. The housing 36 defines an interior space 40. A neck 42 is defined at a first end 44 and an opening 46 is defined at a second end of the housing. The illustrated neck 42 is circular, with an opening to the interior space 40 of the housing. A pair of projections 50 extend radially outward from the neck 42. A pair of panel engaging wings 54 extend from an outer surface 56 of the housing. The panel engaging wings 54 secure the switch housing 36 in a panel cutout (not shown).

The cover 38 covers the opening 46 of the housing 36. Switch terminal slots 58 are defined in the in the cover 38. The cover includes electromagnet terminal supports 60 and a shroud 62 that secure the electromagnet terminals with respect to the cover 38. The shroud mates with a connector (not shown) to connect the electromagnet to a circuit that selectively applies voltage to the electromagnet. Examples of such circuits include ignition circuits and interlock circuits that selectively apply voltage to the electromagnet.

The illustrated switch terminals 12 each include a first portion 64 that extends through a slot 58 in the cover 38. A second terminal portion 66 is disposed inside the housing 36. The second terminal portion 66 includes a rectangular cutout 70. A bend 68 between the first terminal portion 64 and the second terminal portion 66 prevents the second terminal portion from being pulled through the slot 58. The slots 58 secure the switch terminals in a spaced apart relationship with respect to one another.

It should be readily apparent that the terminals that extend from the cover could be in a variety of different configurations without departing from the spirit and scope of the appended claims. For example, a common or ground terminal, a switched terminal and an electromagnet terminal could be included. The common terminal and the switched terminal are bridged (or opened) as the actuator is moved from the first position to the second position. One end of the electromagnet coil is electrically connected to the electromagnet terminal and the other end of the coil is electrically connected to the common terminal. The electromagnet is energized when voltage is applied to the electromagnet terminal.

The switch actuator 14 illustrated in FIGS. 9–13 includes a shaft 72 and a knob 74. The shaft includes an elongated portion 76, a contact carrying portion 78, and a metallic member carrying portion 80. The illustrated elongated portion 76 includes a first cylindrical portion 82 connected to a reduced diameter cylindrical portion 84 at a step 86. The first cylindrical portion 82 includes a channel 85. The elongated portion 76 fits within the interior space 40 defined by the housing 36, such that the elongated member is linearly movable along its axis A, with respect to the housing 36.

Figure 12:
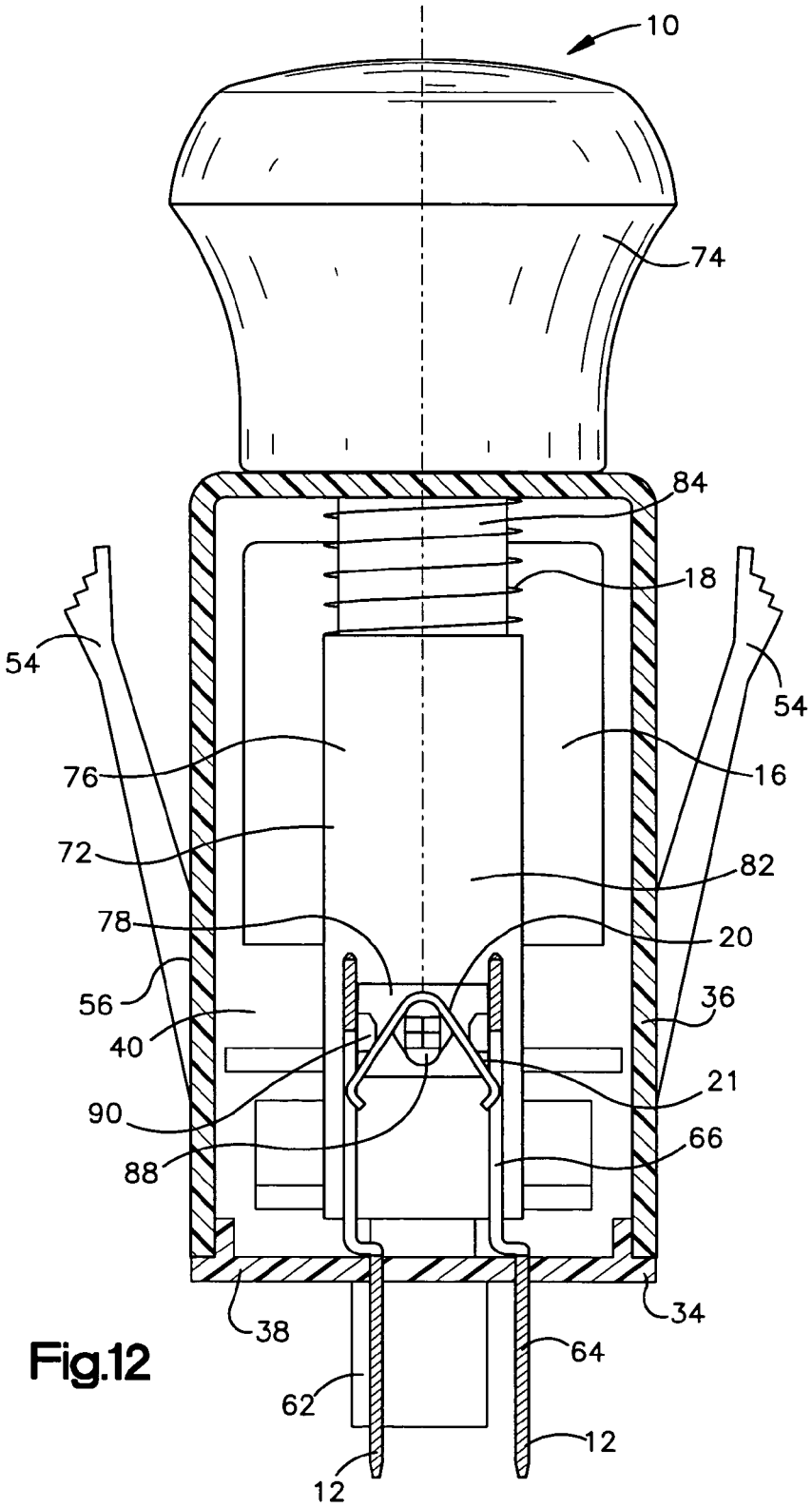
FIG. 12 is a sectional view taken along the plane indicated by lines 12—12 in FIG. 9.

The contact carrying portion 78 includes a central protrusion 88 and a pair of side protrusions 90 that extend outward from the first cylindrical portion 82. The illustrated contact 20 is formed from a flat wire into a substantially "V" shape. The formed contact has two outwardly extending legs 21. To install the contact 20 onto the contact carrying portion 78, the legs 21 are squeezed together slightly and inserted over the central protrusion 88 between the side protrusions 90. The legs 21 are then released to affix the contact to the contact carrying portion 78. The central protrusion 88 and side protrusions 90 are configured such that the contact 20 can be selectively be oriented in two positions, i.e. contact leg portions 92 extending upwardly (FIG. 2) or downwardly (FIG. 12).

Figures 9, 10:
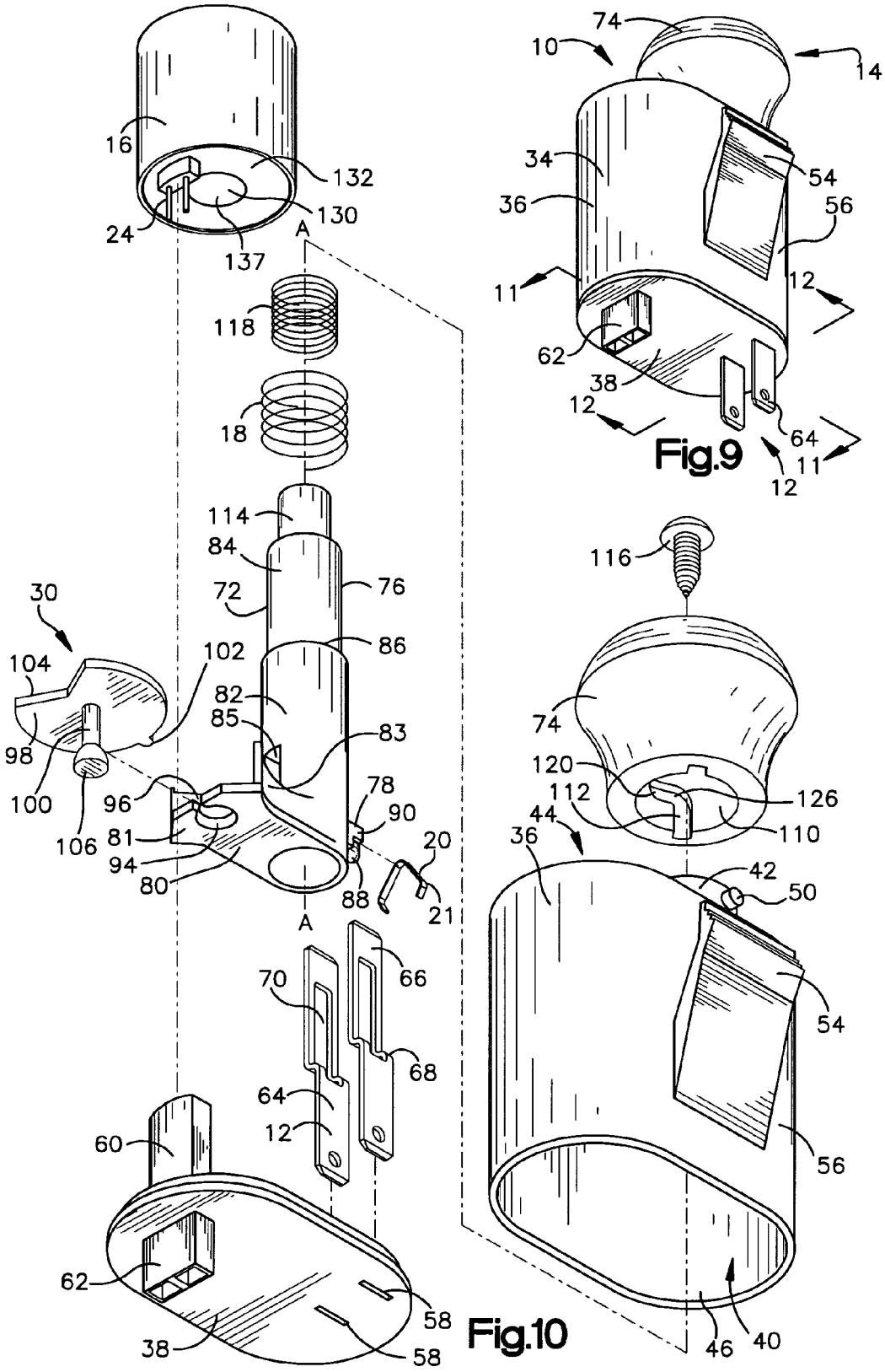
FIG. 9 is a perspective view of an electromagnetic latching switch.
FIG. 10 is an exploded perspective view of an electromagnetic latching switch.
Figure 11:
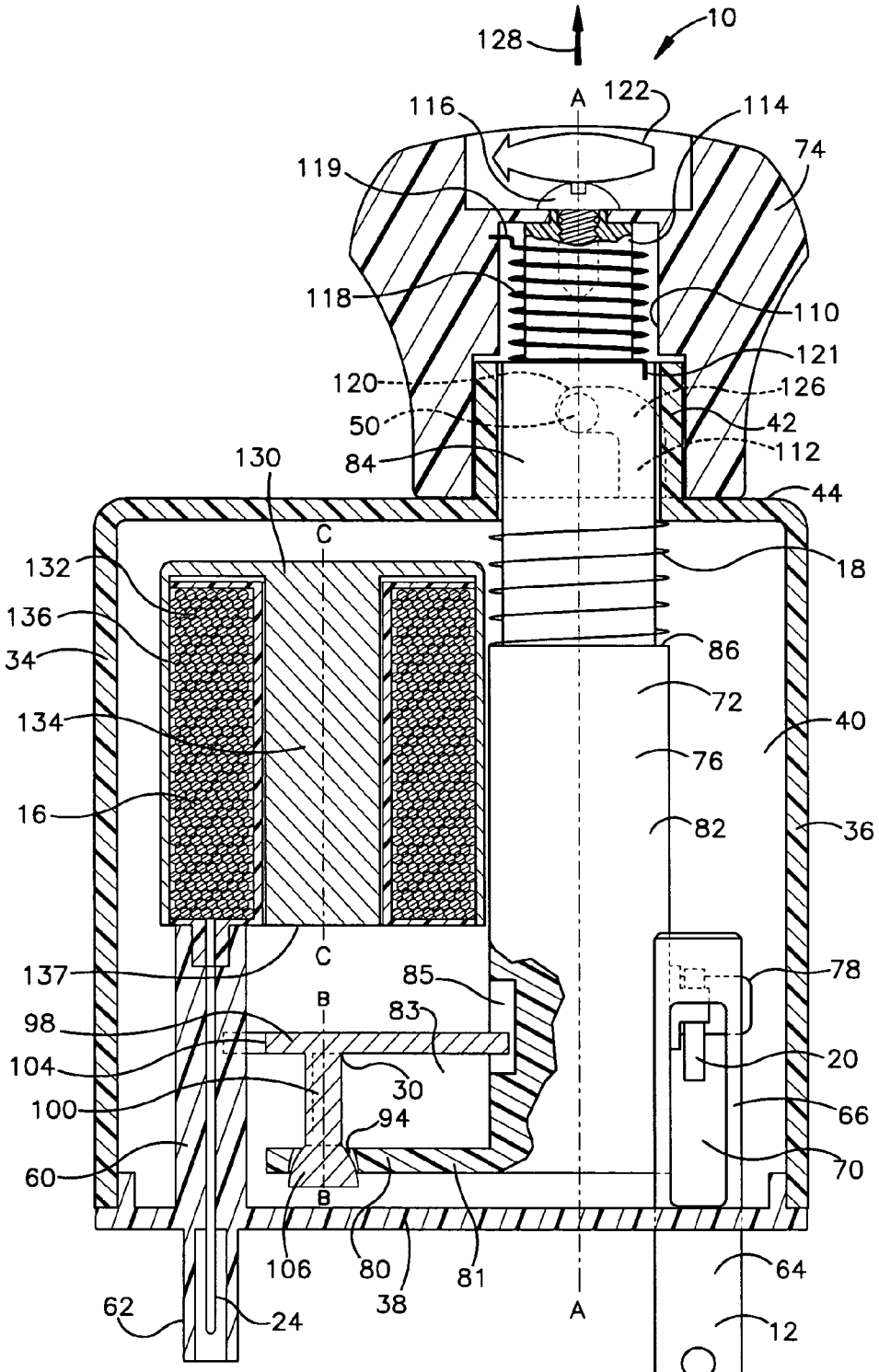
FIG. 11 is a sectional view of an electromagnetic switch taken along the plane indicated by lines 11—11 in FIG. 9 showing an actuator in a normal position.
Figure 13:
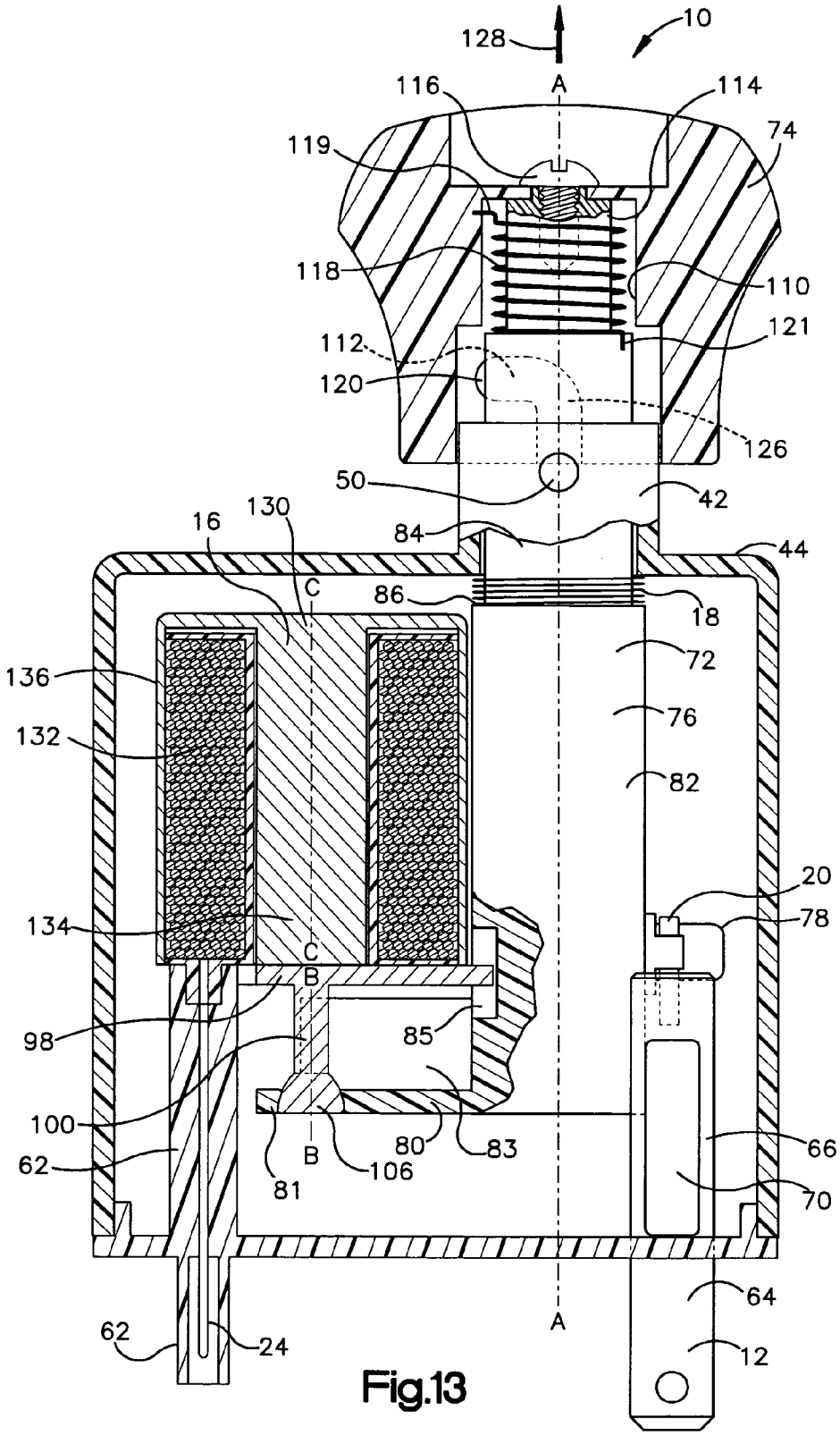
FIG. 13 is a view similar to the view of FIG. 11 with an actuator moved to an actuated position.

In the example of FIGS. 9–13, the metallic member carrying portion 80 extends radially outward from the elongated portion 76. The metallic member carrying portion includes a base portion 81 and walls 83. The base portion includes an opening 94. Referring to FIGS. 11 and 13, the diameter of the opening 84 is greater at the bottom of the base portion 81 than the top of the base portion. This transition is arcuate in the illustrated embodiment. The opening 94 acts as a socket. Referring to FIG. 10, a small channel 96 or cut provides radial access to the opening 94. The walls 83 extend axially from the base portion and generally conform to the shape of the metallic member 30.

Referring to FIG. 10, the illustrated metallic member 30 includes a plate 98 and a post 100. The plate 98 includes a tab 102 and a cutout 104. A stop 106 is formed at an end of the post 100. To connect the metallic member 30 to the metallic member carrying portion 80, the post 100 is pressed through the channel 96 into the opening 94. Referring to FIGS. 11 and 13, the outer surface of the stop 106 is complimentary to the surface defined by the opening 94. As a result, the stop 106 and opening 94 act as a ball and socket joint, allowing the metallic member 30 to pivot with respect to the carrying portion. The stop 106 is also sized to prevent the post 100 from being pulled through the opening 94. The plate 98 is supported by the walls 83 of the metallic member carrying portion. The tab 102 fits within the channel 85 of the shaft 22. Co-action of the tab 102 and the channel 85 inhibit substantial rotational movement of the metallic member 30 about axis B. The illustrated post 100 has a length that is greater than the thickness of the metallic member carrying base portion 81. This allows for relative axial movement of the metallic member 30 with respect to the switch actuator along axis B.

The knob 74 includes an internal bore 110 that defines an internal surface of the knob. A pair of "L" shaped channels 112 are defined inside the knob 74. The "L" shaped channels are disposed around the projections 50 that extend from the housing neck 42. The co-action of the "L" shaped channels 112 and the projections define a path of travel of the knob. The knob 74 is attached to an end 114 of the shaft 72 by a screw 116. In the exemplary embodiment, the attachment of the knob 74 to the shaft 72 permits rotational movement of the knob with respect to the shaft, but prevents substantial axial movement of the knob with respect to the shaft.

The illustrated biasing member 18 is a spring. In the example shown in FIGS. 9–13 the biasing member is disposed around the reduced diameter portion 84 of the shaft 72 and abuts the step 86. Referring to FIGS. 11 and 13, the biasing member 18 also abuts an interior surface of the housing to bias the shaft 72 inward with respect to the housing 36 to the normal position illustrated in FIGS. 11 and 12. In the example shown in FIGS. 9–13, a torsion spring 118 is also included. Referring to FIGS. 11 and 13, the torsion spring 118 is connected to an interior surface of the knob at one end 119 and to the shaft 72 at the other end 121. Referring to FIG. 11, the torsion spring 118 rotatively biases the knob with respect to the shaft 72 and housing 36, such that end portions 120 of the "L" shaped channels are normally positioned around the projections 50 as illustrated by FIG. 11. The torsion spring 118 prevents the actuator from being pulled outward from the normal position to an actuated position, unless the knob is first rotated as indicated by arrow 122. Rotating the knob 74 as indicated by arrow 122 positions corner portions 126 of the channels around the projections 50, allowing the knob (and shaft) to be pulled outward as indicated by arrow 128 with respect to the housing to the position illustrated by FIG. 13.

In the example illustrated by FIGS. 9–13, the contact legs 21 are disposed in the cutouts 70 in the normal position (see FIGS. 11 and 12). As such the switch terminals 12 are electrically isolated in the normal position in this example. When the user rotates the knob as indicated by arrow 122 and pulls the knob as indicated by arrow 128 to the actuated position (FIG. 13), the contact legs 21 contact each of the switch terminals. As such, the switch terminals 12 are electrically bridged in the actuated position in this example.

In the example illustrated by FIGS. 9–13, the electromagnet 16 includes a core 130 and a winding 132. Referring to FIGS. 11 and 13, the core includes a central shaft 134 and a can 136. An end 137 of the central shaft is flat in the exemplary embodiment. The winding 132 occupies the radial space between the central shaft and the can 136. In the exemplary embodiment, the winding 132 is disposed on a bobbin that is disposed inside the can. First and second ends of the winding 132 are electrically connected to the electromagnet terminals 24. The electromagnet terminals extend axially from the electromagnet. In the example of FIGS. 9–13, the cutout 104 in the plate 98 clears the electromagnetic terminals. The electromagnet terminals 24 extend into the electromagnet terminal supports 60 of the cover 38. A power providing circuit is connected to the electromagnet by attaching a connector to the electromagnet terminal supports 60.

In the example illustrated by FIGS. 9–13, the electromagnet is fixed inside the housing 36 such that the metallic member 30 is spaced apart from the electromagnet when the actuator 14 is in the normal position and the metallic member 30 contacts the 130 core of the electromagnet when the actuator is in the actuated position. In the illustrated embodiment, the plate 98 is flat and the end 137 of the central shaft is flat. The plate 98 and the core 130 are in flush engagement when the actuator is in the actuated position and the electromagnet is energized. In the exemplary embodiment, the plate 98 is in flush engagement with both the central shaft end 134 and the can 136 to maximize the force applied to the plate 98 by the electromagnet. When the actuator 14 is released by the user, the biasing member 18 applies a downward force on the shaft 72. This force is translated to the metallic member 30 by the connection between stop 106 and the opening 94. A moment is imparted on the metallic member 30 due to the distance between axis A, along which the force of the spring 18 is applied, and the axis B of the metallic member post 100. The joint formed by the arcuate surfaces of the stop 106 and the opening 94 allow the metallic member 30 to pivot with respect to the metallic member carrying portion 80. This pivoting allows the metallic member 30 to remain in flush contact with the core 130 when the moment is applied and prevents an edge of the plate 98 from being peeled away from the core 130

The shaft 72 maintains a gap between the metallic member 30 and the electromagnet 16 when the actuator is in the normal position. When the shaft 72 is moved to the actuated position, the walls 83 engage the underside of the plate 98 and bring the metallic member 30 into contact with the core. In the example of FIGS. 9–13, a path of travel of the metallic member as the actuator moves back and forth between the normal and actuated positions coincides with an axis C defined by the core of the electromagnet.

The illustrated electromagnet latching switches 10 selectively changes the state of a pair of switch terminals. The switch actuator is moved from a first, or normal position where the switch terminals are in a first state to a second, or actuated position where the switch terminals are in a second state. A magnetic field is selectively applied by an external circuit to maintain the switch actuator in the actuated position. For example, the electromagnet may be coupled to an interlock circuit. The external circuit connects the electromagnet to a source of power when input to the interlock circuit indicates that it is acceptable or safe for the switch 10 to latch or operate in a sustained action mode. When input to the interlock circuit indicates that it is unacceptable or unsafe for the switch 10 to latch or operate in a sustained action mode, the magnetic field is removed. When the magnetic field is removed, the switch actuator is automatically returned from the actuated position to the normal position by the biasing member.

Although the present invention has been described with a degree of particularity, it is the intent that the invention include all modifications and alterations falling within the spirit or scope of the appended claims.

The invention claimed is:

1. A magnetic latching switch, comprising:

a) a selectively energizable electromagnet;

b) a switch housing that supports a first switch terminal and a second switch terminal at fixed locations within a housing interior;

c) a switch actuator which extends into and is supported by the housing that is selectively manually moveable by a user between a first position and a second position;

d) a contact coupled to the switch actuator within said housing such that the contact electrically bridges the first and second switch terminals to close the switch when the switch actuator is in one of the first and second positions and the first and second switch terminals are electrically isolated to open the switch when the switch actuator is in an other of the first and second positions;

e) a biasing member coupled to the switch actuator, such that the switch actuator is biased to the first position;

f) a metallic member coupled to the switch actuator such that a magnetic field applied by the electromagnet to the metallic member when the switch actuator is in the second position and the electromagnet is energized maintains the switch actuator in the second position and wherein the biasing member maintains the switch actuator in the first position when the switch actuator is in the first position and the electromagnet is energized.

2. The magnetic latching switch of claim 1 wherein the switch actuator is only manually moveable by the user from the first position to the second position.

3. The magnetic latching switch of claim 1 wherein the switch actuator is both manually moveable by the user from the second position to the first position and automatically movable from the second position to the first position by de-energizing the electromagnet.

4. The magnetic latching switch of claim 1 wherein the biasing member moves the switch actuator from the second position to the first position when the electromagnet is de-energized.

5. The magnetic latching switch of claim 1 further comprising a pair of electromagnet terminals for coupling the electromagnet to an independent source of power.

6. The magnetic latching switch of claim 1 wherein the terminals are bridged by the contact when the switch actuator is in the second position.

7. The magnetic latching switch of claim 1 wherein the metallic member contacts a core of the electromagnet when the actuator is in the second position.

8. The magnetic latching switch of claim 1 wherein the metallic member and the contact are connected to a shaft that maintains a gap between the metallic member and the electromagnet when the actuator is in the first position and brings the metallic member into contact with the electromagnet when the actuator is moved from the first position to the second position.

9. The magnetic latching switch of claim 1 wherein the metallic member comprises a flat metallic plate.

10. The magnetic latching switch of claim 1 wherein a path of travel of the metallic member as the actuator moves from the first position to the second position coincides with an axis defined by a core of the electromagnet.

11. The magnetic latching switch of claim 1 wherein a core of the electromagnet includes a flat surface and the metallic member comprises a substantially flat plate and wherein the substantially flat plate is in flush contact with the flat surface of the core when the actuator is in the second position and the electromagnet is energized.

12. The magnetic latching switch of claim 1 wherein energization and de-energization of the electromagnet is independent of the position of the switch actuator.

13. The magnetic latching switch of claim 1 wherein the electromagnet is selectively energized by selectively closing an external switch that couples the electromagnet to a source of electrical power.

14. A method of selectively changing the state of a pair of switch terminals, comprising:

a) manually moving a switch actuator from a first position where the switch terminals are in a first state to a second position where the switch terminals are in a second state;

b) applying a magnetic field to maintain the switch actuator in the second position;

c) removing the magnetic field;

d) automatically returning the switch actuator from the second position to the first position when the magnetic field is removed; and e) maintaining the switch actuator in the first position when the magnetic field is applied until the actuator is manually moved to the second position.

15. The method of claim 14 wherein the pair of switch terminals are electrically bridged in the first state.

16. The method of claim 14 wherein the pair of switch terminals are electrically isolated in the first state.

17. The method of claim 14 wherein the pair of switch terminals are electrically bridged in the second state.

18. The method of claim 14 wherein the pair of switch terminals are electrically isolated in the second state.

19. The method of claim 14 wherein the switch actuator is only manually moveable by the user from the first position to the second position.

20. The method of claim 14 wherein the switch actuator is both manually moveable by the user from the second position to the first position and automatically movable from the second position to the first position by removing the magnetic field.

21. The method of claim 14 wherein applying and removing the magnetic field is independent of the position of the switch actuator.

22. The method of claim 14 wherein the magnetic field is selectively applied and removed by selectively closing an external switch that couples an electromagnet to a source of electrical power.

23. A magnetic latching switch, comprising:

a) a pair of switch terminals;

b) a switch actuator that is manually moveable from a first position where the switch terminals are open to a second position where the switch terminals are closed;

c) an electromagnet that selectively applies a magnetic field, wherein applying the magnetic field with the electromagnet when the switch actuator is in the second position maintains the switch actuator in the second position;

d) a biasing member coupled to the switch actuator such that the biasing member automatically returns the switch actuator from the second position to the first position when the magnetic field is removed and wherein the biasing member maintains the switch actuator in the first position when the magnetic field is applied until the actuator is manually moved to the second position.

24. The magnetic latching switch of claim 23 wherein the pair of switch terminals are electrically bridged in the first state.

25. The magnetic latching switch of claim 23 wherein the pair of switch terminals are electrically isolated in the first state.

26. The magnetic latching switch of claim 23 wherein the pair of switch terminals are electrically bridged in the second state.

27. The magnetic latching switch of claim 23 wherein the pair of switch terminals are electrically isolated in the second state.

28. The magnetic latching switch of claim 23 wherein the switch actuator is only manually moveable by the user from the first position to the second position.

29. The magnetic latching switch of claim 23 wherein the switch actuator is both manually moveable by the user from the second position to the first position and automatically movable from the second position to the first position by de-energizing the electromagnet.

30. The magnetic latching switch of claim 23 wherein energization and de-energization of the electromagnet is independent of the position of the switch actuator.

31. The magnetic latching switch of claim 23 wherein the electromagnet is selectively energized by selectively closing an external switch that couples the electromagnet to a source of electrical power.

32. A magnetic latching switch, comprising:

a) a pair of switch terminals;

b) a switch actuator that is manually moveable from a first position where the switch terminals are closed to a second position where the switch terminals are open;

c) an electromagnet that selectively applies a magnetic field, wherein applying the magnetic field with the electromagnet when the switch actuator is in the second position maintains the switch actuator in the second position;

d) a biasing member coupled to the switch actuator such that the biasing member automatically returns the switch actuator from the second position to the first position when the magnetic field is removed and wherein the biasing member maintains the switch actuator in the first position when the magnetic field is applied until the actuator is manually moved to the second position.

* * * * *